US005997053A

United States Patent [19]

Marquez

[11] Patent Number: 5,997,053

[45] Date of Patent: Dec. 7, 1999

[54] LATCH

[76] Inventor: Daniel Marquez, 5190 Genovesio Dr., Pleasanton, Calif. 94588

[21] Appl. No.: 08/938,214

[22] Filed: Sep. 26, 1997

[51] Int. Cl.[6] ..... E05C 1/04

[52] U.S. Cl. ..... 292/153; 292/58; 292/71; 292/304; 292/DIG. 20

[58] Field of Search ..... 292/153, 57, 58, 292/59, 71, 68, 304, DIG. 33, 267, DIG. 4, DIG. 20

[56] References Cited

U.S. PATENT DOCUMENTS

| | | | |
|---|---|---|---|
| 317,986 | 5/1885 | Fowler . | |
| 389,217 | 9/1888 | Glenn | 292/153 |
| 612,671 | 10/1898 | Pease | 292/153 |
| 699,696 | 5/1902 | Mellen | 292/DIG. 20 |
| 828,740 | 8/1906 | Hollopeter | 292/304 |
| 832,731 | 10/1906 | James | 292/57 |
| 922,894 | 5/1909 | Heid | 292/DIG. 20 |
| 1,158,533 | 11/1915 | Moore . | |
| 1,163,086 | 12/1915 | Harper . | |
| 1,171,981 | 2/1916 | Rooney . | |
| 1,398,174 | 10/1921 | Carlson . | |
| 2,274,552 | 2/1942 | Kingsland | 292/DIG. 20 |
| 2,483,061 | 9/1949 | Omans . | |
| 2,506,508 | 5/1950 | Kmita | 292/267 |
| 2,847,239 | 8/1958 | Wallace . | |
| 2,965,918 | 12/1960 | Leanza | 292/267 |
| 2,967,595 | 1/1961 | Zitomer | 292/DIG. 20 |
| 3,151,901 | 10/1964 | Ahlgren . | |
| 3,423,116 | 1/1969 | Dolan | 292/165 |
| 4,571,888 | 2/1986 | Jensen | 49/450 |
| 4,639,039 | 1/1987 | Donovan | 297/353 |
| 4,650,244 | 3/1987 | Boots | 296/223 |
| 5,217,267 | 6/1993 | Yagi | 292/338 |

FOREIGN PATENT DOCUMENTS

| | | | |
|---|---|---|---|
| 1005293 | 3/1957 | Germany | 292/153 |
| 18 76 416 U | 7/1963 | Germany . | |
| 747535 | 5/1954 | United Kingdom | 292/267 |

*Primary Examiner*—Darnell M. Boucher
*Assistant Examiner*—Clifford B. Vaterlaus
*Attorney, Agent, or Firm*—Fish & Richardson P.C.

[57] ABSTRACT

A latching apparatus controls the motion of a first member relative to a second member. The first member is reciprocally moveable relative to the second member in forward and reverse directions along the line of motion. The second member carries a latch which is movable within a plane parallel to the line of motion. The latch has a first pawl and a second pawl. The second member carries a pivot for carrying the latch so that the latch is rotatable relative to the second member about the pivot which is orthogonal to the line of motion. The latch is shiftable between first and second positions relative to the pivot. The first member bears a plurality of engagement features linearly arrayed along the line of motion. Each engagement feature has a generally forward facing first face and a generally rearward facing second face. When the latch is in the first position, it is biased for its first pawl to engage the engagement features. When the latch is in the second position it is biased for its second pawl to engage the engagement features.

20 Claims, 6 Drawing Sheets

LATCH

BACKGROUND

1. Technical Field

This invention relates to latching, and more particularly to latches useful for controlling movement of objects such as doors, windows, and drawers.

2. Background Information

With objects such as sliding windows and doors, especially vertically sliding windows and doors, it is desirable to be able to selectively lock the window or door in a selected intermediate position within its available range of motion. A variety of manual latching systems are in common use. Many such systems require a user to manually actuate an actuator to disengage the latch and permit movement of the window or door. When the window or door is at the selected position, the user releases the actuator (for example, a push-button or lever) to lock the window or door in place. Such systems are often difficult to use, with the actuators requiring that relatively significant force be exerted by the user's fingers at the same time as the user is moving the window or door.

It is therefore desirable that a latching system be provided which combines the action of moving an object with the actuation of the latching mechanism so that the user is confronted with but a single task and can accomplish that task without undue exertion.

SUMMARY

Accordingly, the invention provides a latching apparatus and associated process for controlling the motion of a first member relative to a second member. In one embodiment, the first member is reciprocally movable in forward and reverse directions along a line of motion. The second member carries a latch which is movable within a plane parallel to the line of motion. The latch has a first pawl and a second pawl. The second member carries a pivot for carrying the latch so that the latch is rotatable relative to the second member about the pivot which is orthogonal to the line of motion. The latch is shiftable between first and second positions relative to the pivot. The first member bears a plurality of engagement features linearly arrayed along the line of motion. Each engagement feature has a generally forward facing first face and a generally rearward facing second face. When the latch is in the first position, it is biased for its first pawl to engage the engagement features. When the latch is in the second position it is biased for its second pawl to engage the engagement features.

The bias may be achieved by providing the latch with a center of gravity located forward of the pivot when the latch is in its first position and rearward of the pivot when the latch is in its second position. The bias may be achieved by providing a spring for biasing the latch The latch may have a generally V-shaped slot for accommodating the pivot, the slot having a front terminus and a rear terminus, wherein the pivot is at the rear terminus when the latch is in the first position and at the front terminus when the latch is in the second position.

The latch may be movable between a first state wherein the latch is in the first position, from which first state forward and rearward movement of the first member is unimpeded by the latch, and a second state wherein the latch is held in the first position and the second pawl is engaged to the forward face of one of the engagement features so as to prevent forward movement of the first member relative to the second member. In the first state, the latch may be oriented so that the second pawl does not engage the engagement features. If the latch is in the second state, rearward movement of the first member relative to the second member may be unimpeded by the latch. If the latch is in the second state, rearward movement of the first member relative to the second member may be unimpeded by the latch and such rearward movement may allow the latch to move to the first state.

The engagement features may be linearly arrayed on the first member and may be formed as teeth, each having a front face and a rear face.

In another aspect, the invention provides an apparatus having a first member, a second member and a latching means for preventing forward movement of the first member relative to the second member when in a latched condition, and for permitting forward movement of the first member relative to the second member when in an unlatched condition. The latching means do not prevent rearward movement of the first member relative to the second member.

The latching means are changeable from the latched condition to the unlatched condition by a rearward movement of the first member relative to the second member.

In another aspect, the invention is directed to a process for controlling movement of a first member relative to as second member. The second member carries a latch with at least one rotational degree of freedom and the first member bears a plurality of features for engaging the latch. The first member is moved forward relative to the second member wherein the latch does not prevent motion of the first member relative to the second member. The first member is moved rearward relative to the second member so that one feature engages the latch so as to shift the latch from a forward position to a rearward position while permitting further rearward movement of the first member. The first member is moved forward relative to the second member so that one feature engages the latch so as to prevent further forward movement of the first member. The first member is moved rearward relative to the second member so as to permit the latch to disengage the feature and allow the first member to be moved forward again.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
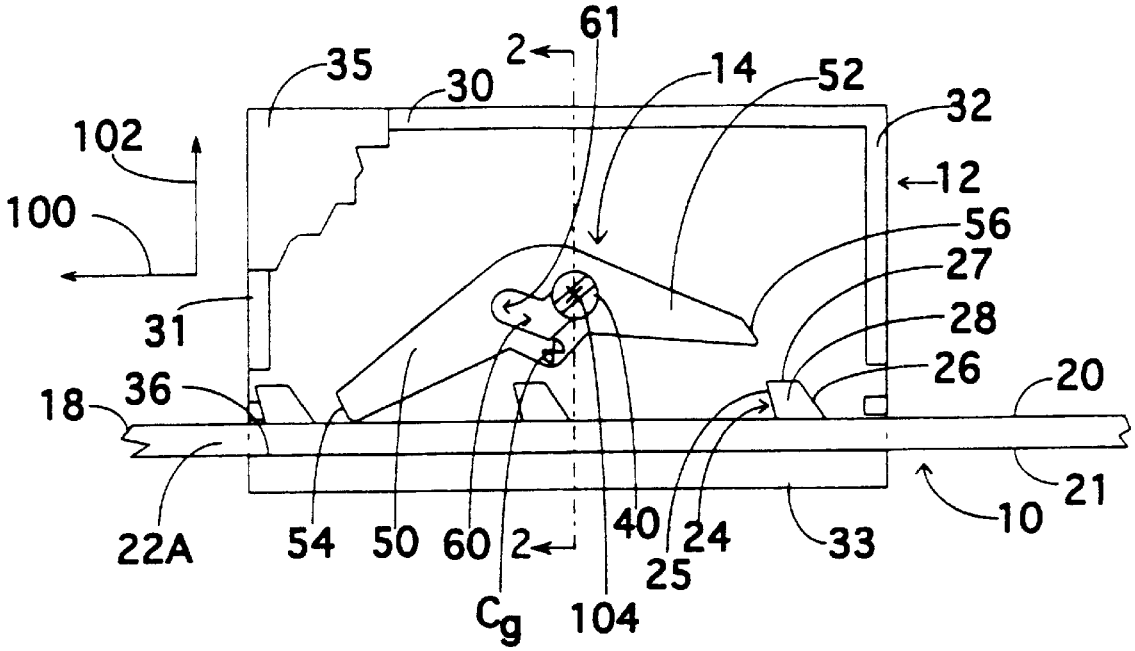
FIG. 1 is a side cutaway view of a latching system according to principles of the invention.

FIG. 1 shows a latching system wherein a movable member 10 is carried by a fixed member 12. The movable member is longitudinally movable relative to the fixed member except to the extent that its movement is governed by a latch 14 as described below. For reference, a forward direction 100 and upward direction 102 are shown. The term "longitudinal" shall be taken to mean parallel to the direction 100. The terms "forward", "front" and the like are understood as indicating relative direction and not requiring that the forward direction always correspond to a direction facing a user.

Figure 2:
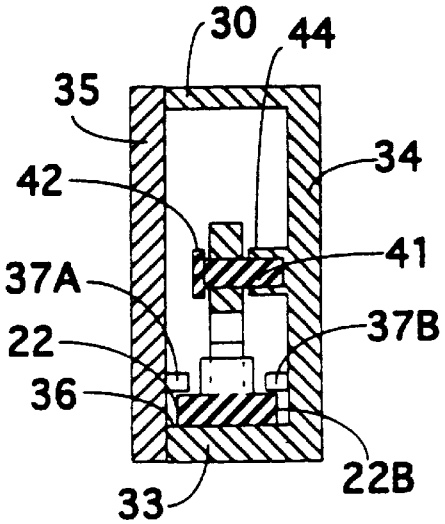
FIG. 2 is a transverse cross-sectional view of the latching system of FIG. 1, taken along line 2—2.

The movable member 10 is formed as an elongate strip or bar-like body 18 with an upper face 20, a lower face 21, and left and right side faces 22A and 22B (FIG. 2). Projecting from the upper face 20 is a linear array of engagement teeth 24. Each tooth 24 has a forward face 25 at an acute angle to the body's upper face 20 and a rear face 26 at an obtuse angle to the upper face 20. Each tooth further has a generally flat top 27 and left and right faces 28A and 28B (FIG. 2) slightly recessed from the left and right faces 22A and 22B of the body 18 of the movable member.

The fixed member 12 is formed having a unitary box comprising: a top 30; front and back ends 31 and 32; a bottom or base 33, and a right side or web 34 connecting the top, bottom and ends. A left side or cover 35 is formed as a separate piece, mateable with the box. The upper face 36 of the bottom 33 supports and is in sliding engagement with the lower face 21 of the movable member 10. A pair of left and right, longitudinally-extending, inwardly-projecting retaining lips 37A and 37B project from the inner faces of the cover 35 and web 34, respectively, extending slightly over the upper face 20 of the body of the movable member 10 so as to restrict upward movement of the movable member.

The latch 14 is carried by the fixed member 12 on a pivot screw 40 having a shaft 41 and head 42 (FIG. 2). The end of the screw shaft is screwed into an internally threaded boss 44 protruding inwardly from the web 34. The central axis 104 of the screw defines a pivot axis, perpendicular to the forward and upward directions 100 and 102, respectively, about which the latch may rotate. The latch 14 is formed as a flat, uniformly thick, generally swept wing-shaped piece. The front arm or wing 50 of the latch and rear arm or wing 52 each serve as a pawl, an end 54 of the front arm engageable with the rear faces 26 of the engagement teeth and an end 56 of the rear arm 52 engageable with the forward faces 25 of the engagement teeth as is described below in detail.

Figure 12:
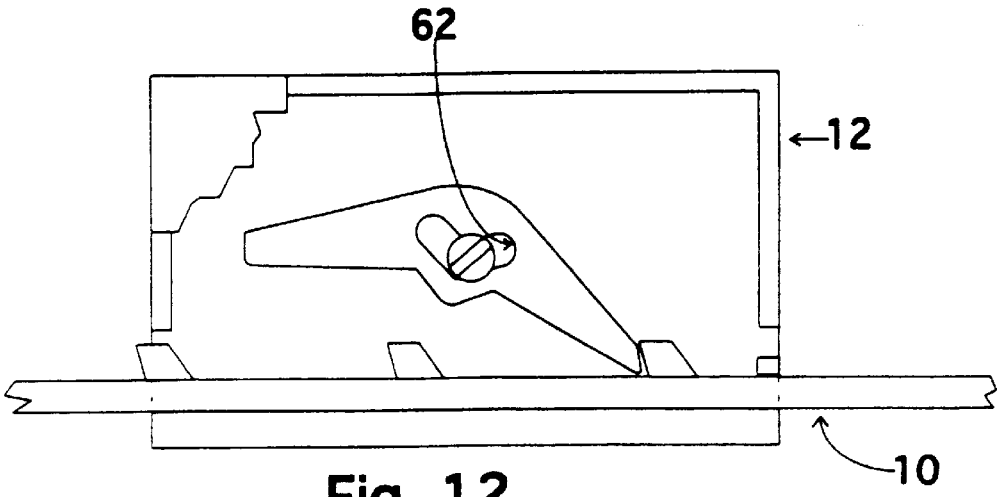

Centrally piercing the latch is a V-shaped slot 60 having a front terminus 61 and rear terminus 62 (FIG.12). The V-shape of the slot is generally vertical, opposite to the sweep or V-shape of the latch. The latch has a center of gravity $C_g$ which is located in the vicinity of the vertex of the slot.

As is described in further detail below, the latch is movable within a plane orthogonal to the axis of rotation 104. It may both rotate relative to the pivot screw 40 and may translate from a first extreme wherein the rear terminus 62 of slot 60 engages the pivot screw 40 to a second extreme wherein the forward terminus 61 engages the pivot screw. With the latch in a first position shown in FIG. 1, the pivot screw is accommodated at the rear terminus 62 and the center of gravity $C_g$ is located forward of the axis 104 so as to bias the latch to rotation counterclockwise as viewed in the drawings. This bias will tend to bring the end 54 of the front arm 50 into engagement with upper face 20 of the movable member and with the engagement features as described in further detail below.

Figure 3:
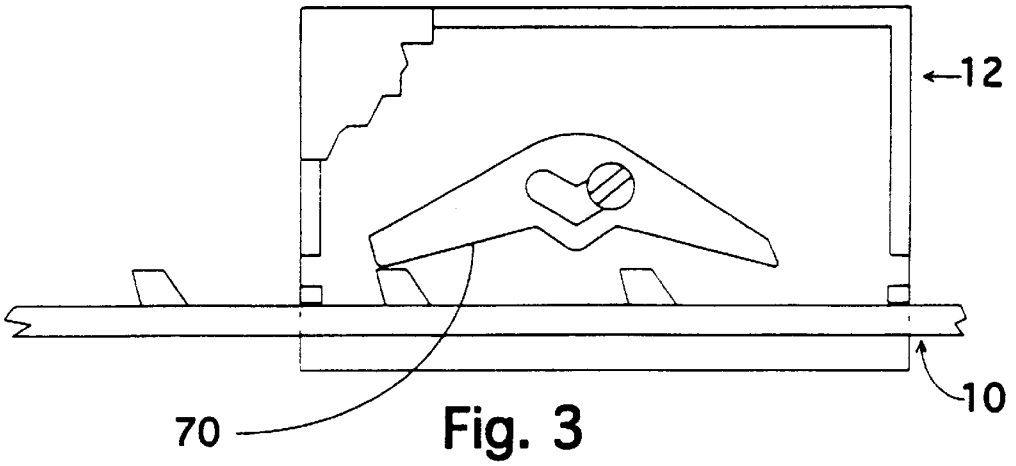
FIGS. 3–14 are side cutaway views of the latching system of FIG. 1 in different stages of operation.
Figure 4:
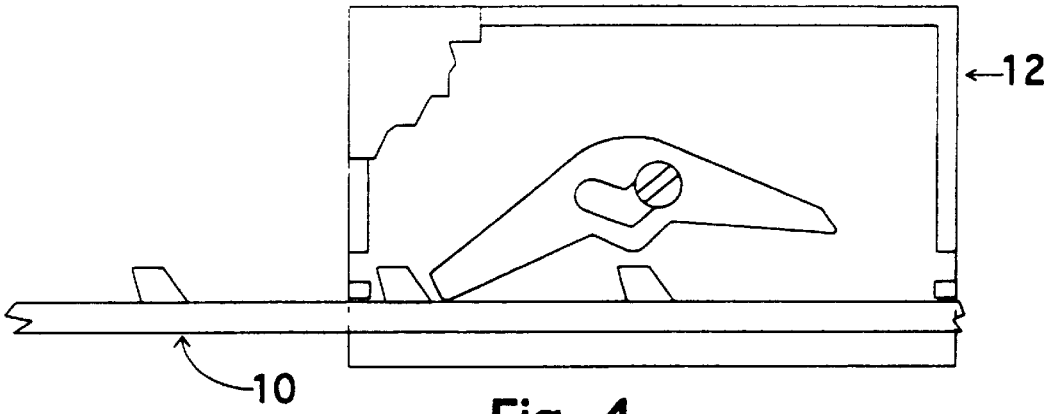

With the latch in the position and orientation (collectively the "state") of FIG. 1, forward movement of the movable member 10 relative to the fixed member 12 is unimpeded by the latch. Specifically, as sequential engagement teeth pass beneath the latch, they engage the lower edge 70 of the front arm 50 (FIG. 3) causing the latch to rotate clockwise. As the movable member moves further forward, the engagement tooth passes out of engagement with the arm allowing the latch to rotate back counterclockwise (FIG. 4) so to return to the state of FIG. 1. In this fashion, each sequential engagement tooth can pass through engagement with latch allowing the movable member to be brought as far forward as is otherwise allowed.

Figure 5:
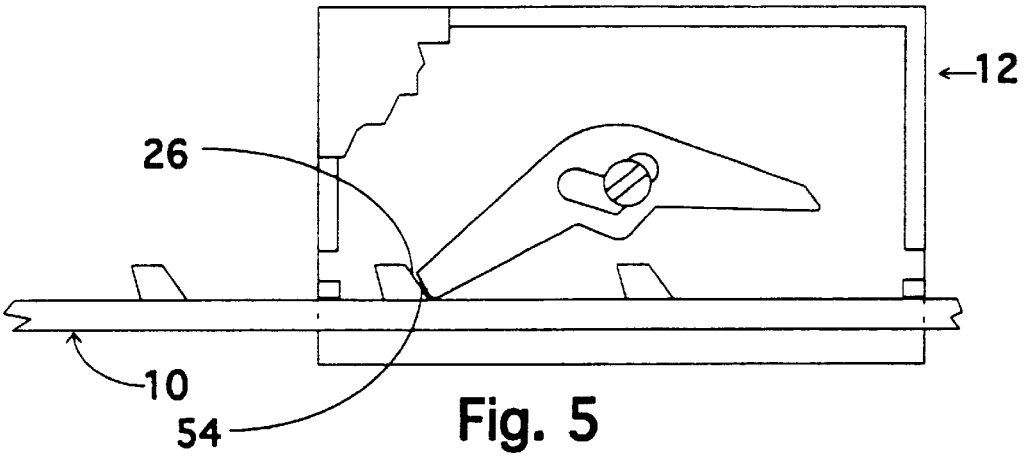
Figure 6:
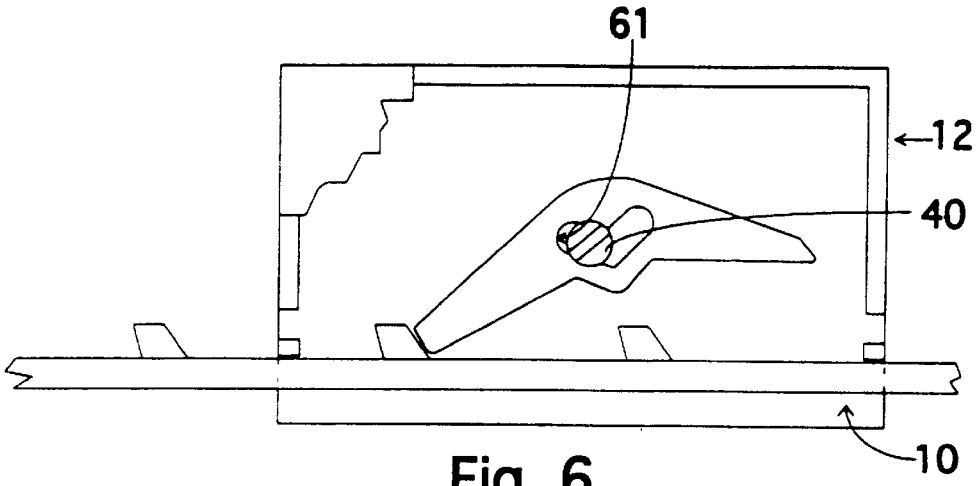
Figure 7:
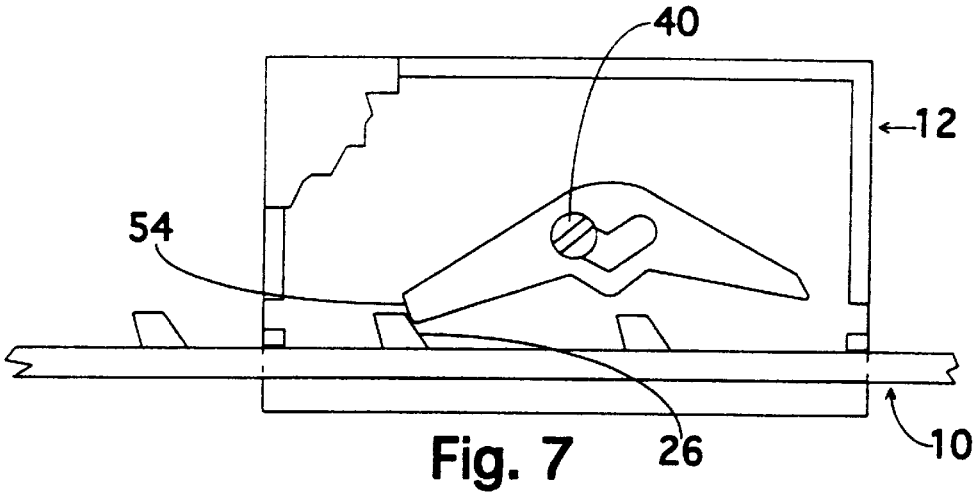
Figure 8:
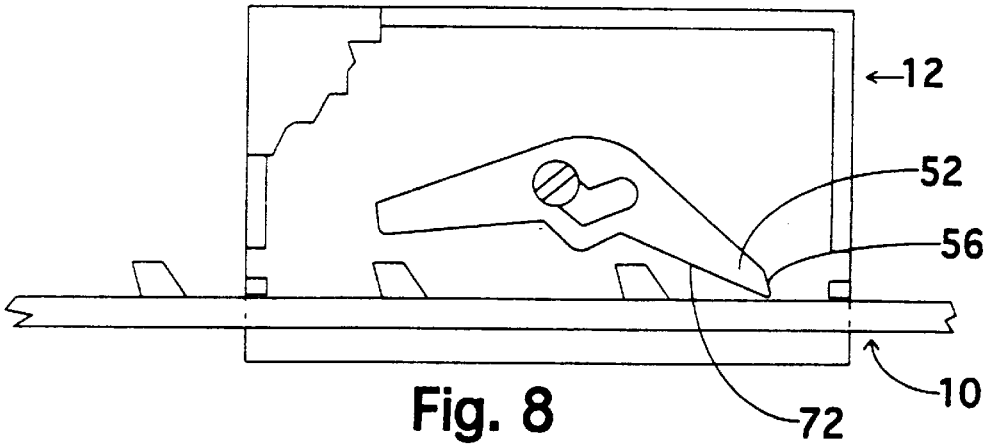
Figure 9:
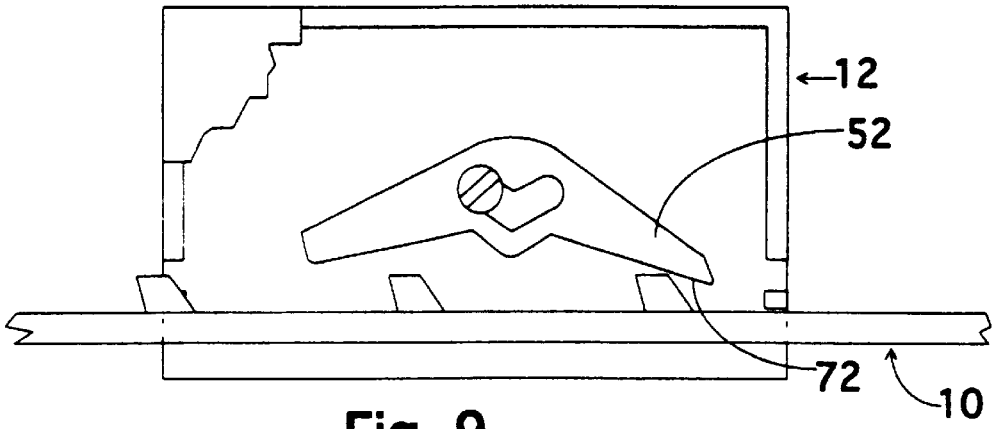
Figure 10:
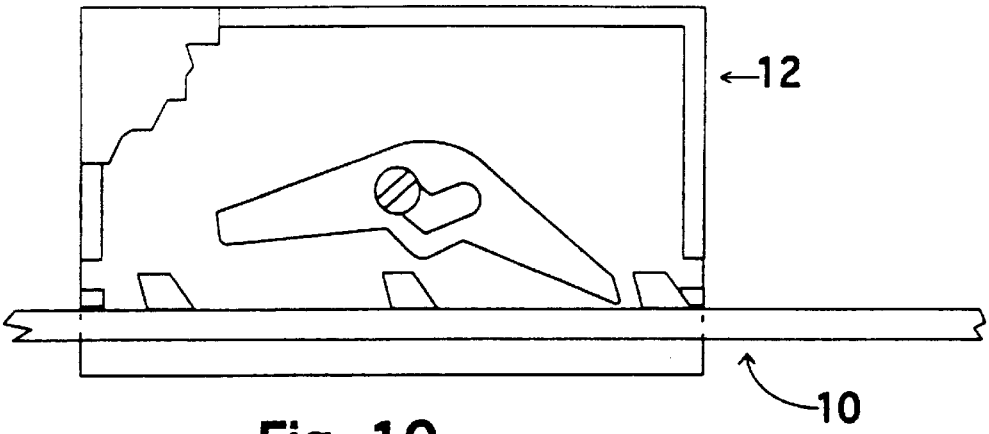
Figure 11:
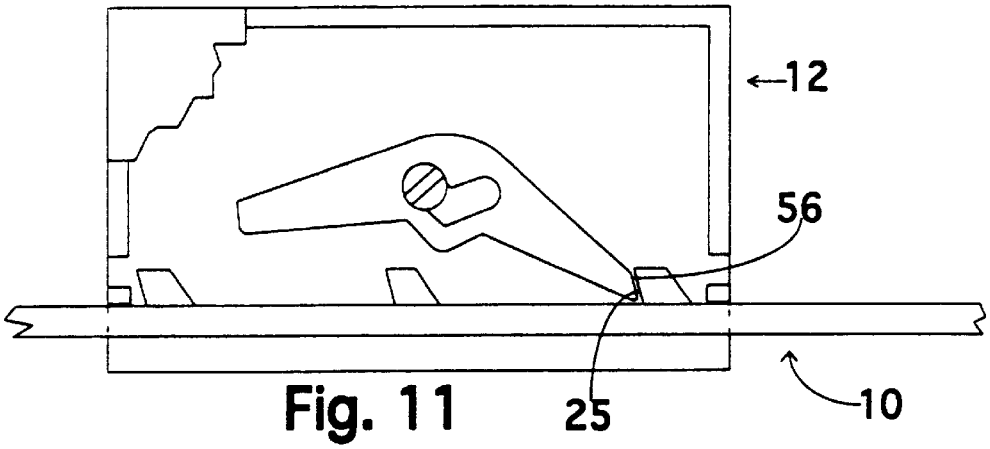
Figure 13:
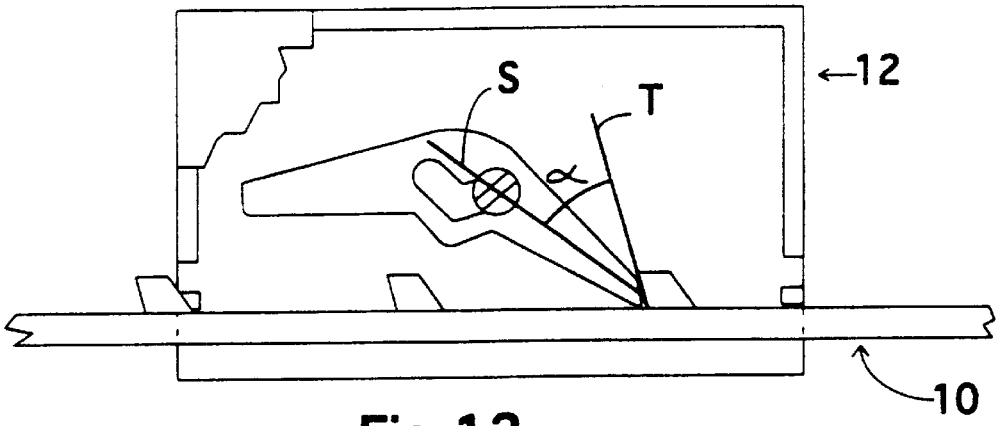
Figure 14:
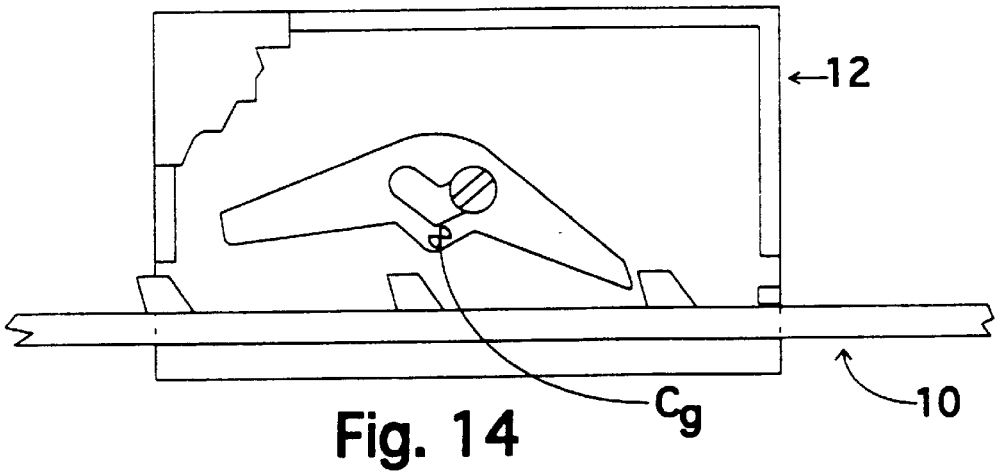

If, however, the movable member is driven rearward from the position of FIG. 1, the rear face 26 of an engagement tooth comes into butting engagement with the end 54 of the front arm of the latch (FIG. 5). Further rearward movement of the movable member drives the latch rearward until it reaches a position where the pivot screw 40 is at the front terminus 61 of the slot (FIGS. 6 & 7). Further rearward motion of the movable member 10 produces a camming action of the arm end 54 over the rear face 26 of the tooth (FIG. 7). With the latch in this position, the center of gravity $C_g$ is rearward of the axis 104 and, thus, once the forward end 54 disengages from the rear face 26 of the engagement tooth, the latch will rotate clockwise under its gravitational bias (FIG. 8) so that the end 56 of the rear arm 52 comes into engagement with the upper face 20 of the movable member 10. Further rearward movement brings sequential teeth into engagement with the lower edge 72 of the rear arm 52 (FIGS. 8 & 9). This engagement first rotates the latch counterclockwise. As successive teeth pass out of engagement with the latch, the latch is allowed to rotate back clockwise to the state of FIG. 8 as seen in the transition from FIG. 8, through FIG. 9, to FIG. 10. If, however, at any point with the latch in its second position, the movable member 10 is moved forward, the end 56 of the rear arm 52 comes into butting engagement with the forward face 25 of an engagement tooth (FIG. 11). As in the case of engagement of the rear face of a tooth with the end of the front arm 50, this engagement drives the latch so as to move it between positions. In this case, the latch is moved so that the pivot screw 40 which had been accommodated at the forward terminus 61 of slot 60 is now accommodated at the rear terminus 62 of slot 60 (FIGS. 11–13). However, unlike the engagement of the rear face 26 to the end 54 of the front arm 50, engagement of the forward face 25 to the end 56 of rear arm 52 does not produce the same camming action. There is an acute angle a between: (I) the upwardly directed surface tangent T of the forward face 25 at the point of contact; and (ii) the vector S from the point of contact to the axis 104. Thus, the engagement tends to drive the latch clockwise so as to bear against the movable member to prevent further forward motion of the movable member. This defines a locked state shown in FIG. 13. If the movable member is then moved slightly to the rear (FIG. 14), because $C_g$ is now forward of the axis 104, the disengagement of the forward face 25 of the tooth from the end 56 of the rear arm 52 allows the latch to rotate counterclockwise and return to the state of FIG. 1, whereupon further movement of the movable member either rearward or forward is unimpeded.

Figure 15:
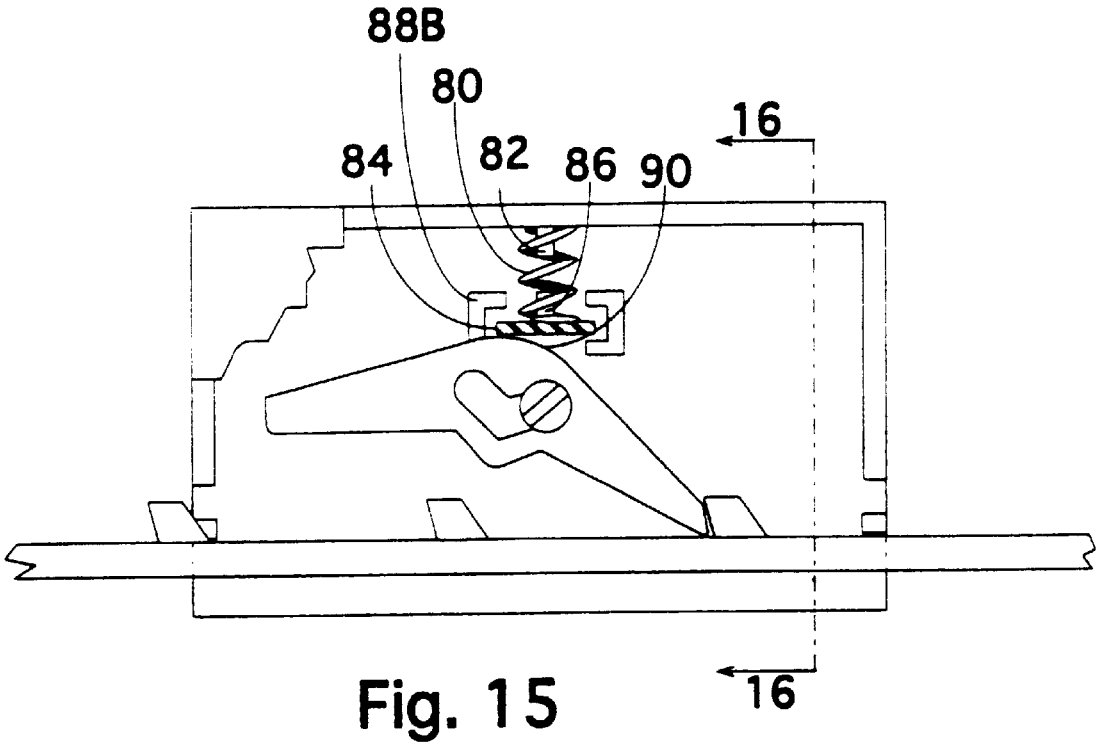
FIG. 15 is a side cutaway view of a second latching system according to principles of the invention.
Figure 16:
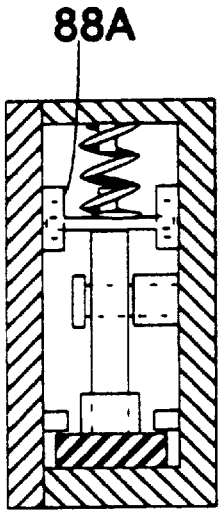
FIG. 16 is a transverse cross-sectional view of the latching system of FIG. 15, taken along line 16—16.

In an embodiment of the invention shown in FIG. 15, the rotational biases due to gravitational force may be supplemented or replaced by another biasing force such as that from a compression spring 80, secured on a stud 82 depending, e.g., from the top 30 of the fixed member. At the distal end of the spring, a follower plate 84 is held to the spring by a stud 86 and constrained against lateral and longitudinal movement by a pair of bosses 88A and 88B extending inwardly from the inner faces of cover 35 and web 34, respectively. The follower plate 84 engages the rounded upper contour 90 of the latch so that spring compression biases the latch to rotate counterclockwise when the latch is in the first position and clockwise when the latch is in the second position. Such biasing means will allow such latches to be used independently of the gravitational frame of reference.

Latches according to the principles of the invention may be used to control a variety of systems such as swinging or sliding doors, sliding windows, rolling screens or blinds, and sliding drawers. By way of a nonlimiting example, in the case of a sliding window, the latch could be used to allow a window sash to lock in a plurality of locations where it would be held against the force of gravity. The sash can be raised slightly to unlock and thereby allow the sash then to be lowered all the way or merely to an intermediate position whereupon a slight raising of the sash would relock the sash in the intermediate position. A similar mechanism could be used to prevent drawers from opening more than a desired amount, a useful feature in situations where the drawers may be subject to inertia or other forces such as on a ship or other vehicle.

A number of embodiments of the present invention have been described. Nevertheless, it will be understood that various modifications may be made without departing from the spirit and scope of the invention. For example, if the movable member is provided as a flexible band, the upper face 36 of the bottom 33 of the fixed member 12 (or other structure supporting and accommodating the movable member 10) may be curved or otherwise shaped to accommodate the movable member. Furthermore, if the movable member is provided as a cylindrical surface of sufficiently large radius, with the engagement teeth projecting radially outward therefrom, the latch may be used to control rotation of the movable member about its central axis.

The fixed member 12 and movable member 10 may be reversed. Thus, depending upon the application, either the member 10 bearing the engagement features or the member 12 bearing the latch may be stationary in the user's frame of reference, or neither may be stationary in the user's frame of reference. As such, as described herein any relative forward or rearward motion described is merely relative motion and does not require a particular frame of reference. Thus, as used in the claims, forward motion of the first member relative to the second member shall be the same as rearward motion of the second member relative to the first member. Accordingly, other embodiments are within the scope of the following claims.

What is claimed is:

1. A process for controlling the movement of a first member relative to a second member, the second member carrying a movable latch with at least one rotational degree of freedom and the first member bearing a plurality of engagement features linearly arrayed along a line of motion for engaging the latch, the process comprising the sequential steps of:

a) moving the first member and the linearly arrayed engagement features along the line of motion thereon forward relative to the second member wherein the latch does not prevent motion of the first member relative to the second member;

b) moving the first member and the linearly arrayed engagement features along the line of motion thereon rearward relative to the second member so that one said engagement feature engages the latch so as to shift the latch along a generally V-shaped slot in the latch that accommodates a pivot carried by the second member, from a forward position to a rearward position while permitting further rearward movement of the first member;

c) moving the first member and the linearly arrayed engagement features along the line of motion thereon forward relative to the second member so that one said engagement feature lockingly engages the latch so as to prevent further forward movement of the first member; and d) moving said first member and the linearly arrayed engagement features along the line of motion thereon rearward relative to the second member so as to permit the latch to disengage the lockingly engaged engagement feature and allow the first member to be moved forward again.

2. The process of claim 1, wherein more than one said engagement feature may be lockingly engaged with the latch to prevent further forward movement of the first member at more than one position.

3. A latching apparatus comprising:

a) a first member having a plurality of engagement features linearly arrayed along a line of motion of the first member, each engagement feature having a generally forward facing first face and a generally rearward facing second face;

b) a second member, the first member being movable relative to the second member in forward and reverse directions along the engagement features linearly arrayed along the line of motion;

c) a latch for controlling motion of the first member relative to the second member, the latch carried by the second member and movable within a plane parallel to the line of motion, the latch having a first pawl and a second pawl; and d) a pivot carried by the second member for carrying the latch, the latch rotatable within said plane relative to the second member about a pivot axis orthogonal to the line of motion and shiftable between first and second positions relative to the pivot;

wherein the latch includes a generally V-shaped slot for accommodating the pivot, the slot having a front terminus and a rear terminus, and wherein the pivot is at the rear termins when the latch is in the first position and the pivot is at the front terminus when the latch is in the second position, such that the latch is biased for the first pawl to engage the engagement features when the latch is in the first position and for the second pawl to engage the engagement features when the latch is in the second position, respectively.

4. The apparatus of claim 3, wherein the latch is movable within said plane between:

a first state, wherein the latch is in the first position, from which first state forward and rearward movement of the first member is unimpeded by the latch; and a second state, wherein the latch is held in the first position and the second pawl is engaged to the forward face of one of the engagement features so as to prevent forward movement of the first member relative to the second member.

5. The apparatus of claim 4, wherein:

in the first state, the latch is oriented so that the second pawl does not engage the engagement features.

6. The apparatus of claim 5, wherein:

if the latch is in the second state, rearward movement of the first member relative to the second member is unimpeded by the latch.

7. The apparatus of claim 5, wherein:

if the latch is in the second state, rearward movement of the first member relative to the second member is unimpeded by the latch and such rearward movement allows the latch to move to the first state.

8. A latching apparatus, comprising:

a latch, carried by a first member, the latch having a generally V-shaped slot and being movable within a longitudinal plane and having front and rear pawls;

a pivot coupled to the first member, the generally V-shaped slot of the latch accommodating the pivot and enabling the latch to rotate in the longitudinal plane and relative to which pivot the latch may shift within the longitudinal plane between first and second positions, the latch being biased in the first position so as to rotate in a first directional in the plane and biased in the second position so as to rotate in a second direction opposite the first direction; and a plurality of engagement features on a second member, the engagement features longitudinally linearly arrayed along a line of motion and each engagement feature having a front face and a rear face;

wherein:

if the latch is in the first position and the front pawl is engaged to one of the engagement features, forward movement of the second member sequentially brings the front faces of the engagement features into engagement with a lower edge of the front pawl, during which movement as each engagement feature passes through engagement with the lower edge of the front pawl, the latch is first caused to rotate in the second direction and then allowed to rotate back in the first direction;

if the latch is in the second position and the rear pawl is engaged to one of the engagement features, forward movement of the second member brings the front face of one of the engagement features into engagement with the rear pawl and drives the latch into the first position and further forward movement of the second member is prevented by the engagement;

if the latch is in the first position and the front pawl is engaged to one of the engagement features, rearward movement of the second member brings the rear face of one of the engagement features into engagement with the front pawl and drives the latch into the second position and the latch is allowed to rotate in the second direction, whereupon, further rearward movement is permitted; and if the latch is in the second position and the rear pawl is engaged to the front face of one of the engagement features, rearward movement of the second member allows the latch to rotate in the first direction to disengage the rear pawl from the front face of the engagement feature and further rearward movement of the second member causes the latch to be in the first position and brings the front pawl into engagement with the rear face of an engagement feature.

9. The apparatus of claim 8, wherein the latch is biased in the first position so as to rotate in the first direction in the plane and biased in the second position so as to rotate in the second direction in that the latch has a center of gravity located forward of the pivot when the latch is in its first position and rearward of the pivot when the latch is in its second position.

10. The apparatus of claim 8, wherein the slot has a front terminus and a rear terminus, the pivot being at the rear terminus when the latch is in the first position and at the front terminus when the latch is in the second position.

11. The apparatus of claim 8, wherein the first member carries at least one spring for biasing the latch so as to rotate the latch in the first direction in the plane, when the latch is in the first position, and so as to rotate the latch in the second direction in the plane, when the latch is in the second position.

12. The apparatus of claim 8, wherein the engagement members are linearly arrayed with a uniform spacing between each engagement member and wherein the front face of each engagement member is at an acute angle to a surface of the second member from which the engagement members project and the rear face of each engagement member is at an obtuse angle to the surface of the second member from which the engagement members project.

13. A latching apparatus, comprising:

a) a latch carried by a first member and having a generally V-shaped slot, a first pawl and a second pawl;

b) a pivot coupled to the first member and disposed through the generally V-shaped slot for carrying the latch, the latch being rotatable relative to the first member about the pivot and shiftable between forward and rearward positions relative to the pivot; and c) a plurality of engagement teeth linearly arrayed along a line of motion on a second member, each of the engagement teeth having a front face and a rear face;

wherein the latch is biased for the first pawl to engage the rear face of one of the engagement teeth when the latch is in the forward position and for the second pawl to engage the front face of one of the engagement teeth when the latch is in the rearward position, respectively.

14. A latching apparatus, comprising:

a first member having a plurality of engagement features;

a second member having a pivot; and a latch having a generally V-shaped slot, a forward arm extending in a generally forward direction and a rearward arm extending in a generally rearward direction, the generally V-shaped slot accommodating the pivot and enabling the latch to move relative to the second member, the latch being characterized by (i) a first latch position wherein the forward arm serving as a first pawl is biased into contact with the first member and the first member is movable in the forward direction relative to the second member over a distance that is greater than a spacing between adjacent engagement features; and (ii) a second latch position wherein the rearward arm serving as a second pawl is biased into contact with the first member and the first member is movable in the rearward direction relative to the second member over a distance that is greater than a spacing between adjacent engagement features.

15. The latching apparatus of claim 14 wherein, with the latch in the second latch position, forward movement of the first member relative to the second member lockingly engages the rearward arm with one of the engagement features.

16. The latching apparatus of claim 15 wherein the rearward arm is disengaged from one of the engagement features by moving the first member in a rearward direction relative to the second member to thereby move the latch into the first latch position.

17. The latching apparatus of claim 14 wherein, with the latch in the first latch position, rearward movement of the first member relative to the second member moves the latch into the second latch position.

18. The latching apparatus of claim 14 wherein gravity acts on the latch to bias the forward arm and the rearward arm into contact with the first member.

19. The latching apparatus of claim 14 further comprising a biasing member constructed to bias the forward arm and the rearward arm into contact with the first member.

20. The latching apparatus of claim 19 wherein the biasing member comprises a spring.

* * * * *